United States Patent [19]

Neal et al.

[11] 4,454,740

[45] Jun. 19, 1984

[54] METHOD FOR SIMULTANEOUS PEENING AND SMOOTHING

[75] Inventors: James W. Neal, Columbia; Joseph F. Loersch, Bolton, both of Conn.

[73] Assignee: United Technologies Corporation, Hartford, Conn.

[21] Appl. No.: 300,725

[22] Filed: Sep. 10, 1981

[51] Int. Cl.[3] ..... C21D 7/06

[52] U.S. Cl. ..... 72/53

[58] Field of Search ..... 72/53, 40; 29/23.5, 29/556.8 R, 556.8 B

[56] References Cited

U.S. PATENT DOCUMENTS

| | | | |
|---|---|---|---|
| 937,180 | 10/1909 | Ridd . | |
| 3,705,511 | 12/1972 | Brandel | 72/53 |
| 4,034,585 | 7/1977 | Straub | 72/53 |

FOREIGN PATENT DOCUMENTS

| | | | |
|---|---|---|---|
| 143742 | 9/1980 | U.S.S.R. | 72/53 |

OTHER PUBLICATIONS

Carlin, "What Makes a Good Steel Shot", Metal Progress; Jun. '59; pp. 83–85.

Person, "Effect of Shot Peening Variables . . . ," Metal Progress; Jun. '81, pp. 33–35.

ASM "Shot Peening," Metals Handbook, vol. 2, pp. 398–405, (1964), Amer. Soc. for Metals.

Pope, Mohamed "Residual Plastic Strains . . . ," Jnl. Iron & Steel Inst., vol. 180, pp. 285–297 (Jul. 1955).

Kurz, "The Merits of Shot Peening," Production, pp. 107–111.

Kurz, "Shot Peening," Modern Machine Shop, (Jun. 1967), pp. 4–12; 20–23; 32–35.

Robertson, "The Effects of Shot Size on Residual . . . ," No. 710284 (Sep. 1968), SAE Transactions.

Brandel, Klass "Ball Forming Solves Contouring Problems," Metal Progress, (Mar. 1971), pp. 56–57.

Mock "Mechanical Finishes Brighten . . . ," Materials Engineering (Sep. 1968), pp. 64–66.

Pangborn Corp., "Shot Peening".

Metal Improvement Corp., "Shot Peening Applications," 6th Ed., (1980), pp. 3–10; 17;25–27;35.

Soc. Auto. Engineers, AMS-2430H Specification, (1972), pp. 1–15.

U.S. Gov't. Military Specification Mils-13165B, (Dec. 1966), pp. 1–22.

*Primary Examiner*—Gene P. Crosby

*Attorney, Agent, or Firm*—C. G. Nessler

[57] ABSTRACT

A method for simultaneously shot peening and smoothing includes use of relatively large, smooth, hard, spherical steel shot having a substantially uniform diameter in the range 1–2.5 mm. Titanium workpieces are provided in one step with a compressive stress layer of the order of 0.13 mm and a surface finish of better than $15\times10^{-6}$ inch AA, compared to conventional peened finishes of the order of $40\times10^{-6}$ inch AA. Surface finish and peening intensity are inter-related and dependent on shot diameter, mass, velocity, and energy within relatively small limits. The shot diameter is uniform within ±0.05 mm; the shot impact velocity is uniform within ±4 percent or less, in the range 1.4–12 m/s.

11 Claims, 11 Drawing Figures

METHOD FOR SIMULTANEOUS PEENING AND SMOOTHING

DESCRIPTION

1. Technical Field

The present invention relates to the finishing of metal surfaces, most particularly to shot peening processes which impart to a metal surface a combination of compressive stress and texture.

2. Background Art

Shot peening is a manufacturing process wherein the surface of a workpiece is impacted by particles or shot. An important use of peening is to generate a residual compressive stress in surface of a metal workpiece, to improve fatigue resistance. Thus, localized areas of tensile stress, phase transformations, machine and grinding marks, pits, scratches, and the like, can be blended and effectively eliminated from acting as stress concentration points.

Shot peening at low intensities, most often with glass beads, is used in the aircraft gas turbine engine field to enhance the performance of disks, vanes, and blades which are subject to high fatigue stresses. Characteristically, shot peening leaves a textured surface owing to the slightly rounded depressions each particle impact produces.

Recently, it has been appreciated that the efficiency of gas turbines can be enhanced by making the surface of peened compressor airfoils very smooth. Finishes of the order of 15 AA (Arithmetic Average; $10^{-6}$ inch; equal to Ra in ANSI B46-1-77) or better are desired. However, since airfoils typically have contoured surfaces, they are difficult to easily polish without incurring unacceptable change in dimension. Thus, abrasive polishing using a vibrating mass media, following the peening step, has been preferred. But this, and any other surface removal process, risks removal of too much of the necessary peened surface layer. Also such processes tend to be time consuming. Therefore, there has been a need for a simpler improved process.

In peening, shot size is usually chosen according to the size of the workpiece and finish desired. There are many different choices, as indicated by the specification SAE J444a (Society of Automotive Engineers). The nominal size of shot varies from 4.75 to 0.075 mm, and typically is cast steel or iron material. Glass beads in the range of 1.4 to 0.038 mm nominal diameter are also commonly used. Commerical shot is characterized by a relatively wide particle distribution about the mean or nominal size. In addition, the shot tends to fragment during use, leading to the presence of smaller jagged fragments. As a result, shot peening gives a textured surface finish and the surface finish can vary over time with a given shot mass.

Large shot will tend to give a smoother surface finish than small shot, when obtaining the same peening intensity. However, larger shot is undersirable because the time to obtain a fully peened surface becomes considerably greater, and production rate is lowered. Also, large shot has limited utility on many complex shaped parts where small internal contours cannot be properly impacted. Thus, for production shot peening, the smaller shot is preferred.

In addition to improved fatigue resistance, variations of peening processes have been used in the past to provide various surface finishes on workpieces. For example, Ridd U.S. Pat. No. 937,180 discloses a method of obtaining a mottled effect on otherwise smooth sheets. Hardened steel balls are dropped from a series of funnels onto an inclined sheet workpiece placed below. Brandel U.S. Pat. No. 3,705,511 describes a low penetration ball forming process, for contouring aluminum sheet which is stretched across a convex die. Steel balls in the range of 3–6 mm diameter fall by gravity from the edge of an inclined surface, impacting the exposed convex surface of the sheet at about 5 m/sec. The workpiece is translated under the shot stream for a time sufficient to permanently deform the sheet (owing to the residual stresses) but insufficient to deform the sheet greater than the die shape provides. When used for wing panels on aircraft, the contouring process is followed by a conventional shot peening using smaller S230 (~0.7 mm) shot, to obtain the requisite uniform residual stress for fatigue resistance.

SUMMARY OF THE INVENTION

An object of the invention is to produce parts having both a uniform residual surface stress state and a smooth surface finish.

The method of the invention is based on the discovery of critical interdependencies between shot size, energy, peening intensity, and surface finish. According to the invention, a workpiece is simultaneously provided with compressive stresses corresponding to a peening intensity of 0.1 mm N or greater, and a surface finish smoother than 40 AA by impacting it with spherical shot having substantially uniform diameter in the range 1–2.5 mm, preferably 1.5–2 mm, traveling at a substantially uniform velocity. The shot must be infrangible, so it maintains its sphericity in use, and have a surface finish better than 30 AA. By substantially uniform diameter is meant that the shot body will be comprised of particles having diameters within about ±0.05 mm, or uniform within ±5%. This will provide unit masses uniform within about ±16%.

In the invention, the shot is impacted on the workpiece at a velocity less than 15 meter/sec, preferably in the range 1.4–12 m/s, more preferably in the range 2.5–7.8 m/s. The impact velocity will vary according to the desired peening intensity and the diameter of the shot used, with higher velocities being associated with higher intensity and smaller diameter. The impact velocity will be uniform within about ±4% when the preferred method of acceleration, by force of gravity, is used. Resultant unit impact energies will be uniform within about ±25%, in the range of $0.2\times10^{-4}$ to $12\times10^{-4}$ J.

The final surface finish depends on the initial finish. If a titanium workpiece surface has an initial finish of less than about 40 AA, the process is capable of producing final finishes of 15 AA or better. When the workpiece is provided with a smoother initial finish, final finishes down to 6 AA are attainable.

The workpiece finish is dependent on the peening intensity and diameter of shot. For any given shot size, higher peening intensities are associated with poorer finishes. However, at any given intensity a better finish is produced by a larger shot size. As an example, to obtain better than 15 AA surface finish, the intensity of shot peening must be less than about 0.30 mm N. Using 1.8 mm shot enables up to about 0.50 mm N. As a corollary, at any given peening intensity the finish will be better for the larger shot. As an example, for commonly encountered peening intensities in the range 0.20–0.30 mm N, shot significantly smaller than 1 mm will not be capable of producing a requisite smooth surface of 15 AA, whereas shot greater than 2 mm gives a good finish, but without advantage over 2 mm shot. Shot up to 2.5 mm is useful, nonetheless, when high peening intensities are required. But associated with larger shot and especially that over 2.5 mm are long peening (saturation) times and low impact velocities which introduce practical problems in controlling uniformity and obtaining good results on inside radius contours.

When the shot is accelerated by gravity over drop height of 0.1–6 m, using apparatus and methods described in a copending application, the uniform velocities of the invention will be attained, together with shot which travels along an essentially collimated path. Consequently a precision of shot peening and surface finishing can be obtained which is economic and heretofore unknown.

BEST MODE FOR CARRYING OUT THE INVENTION

Figure 1:
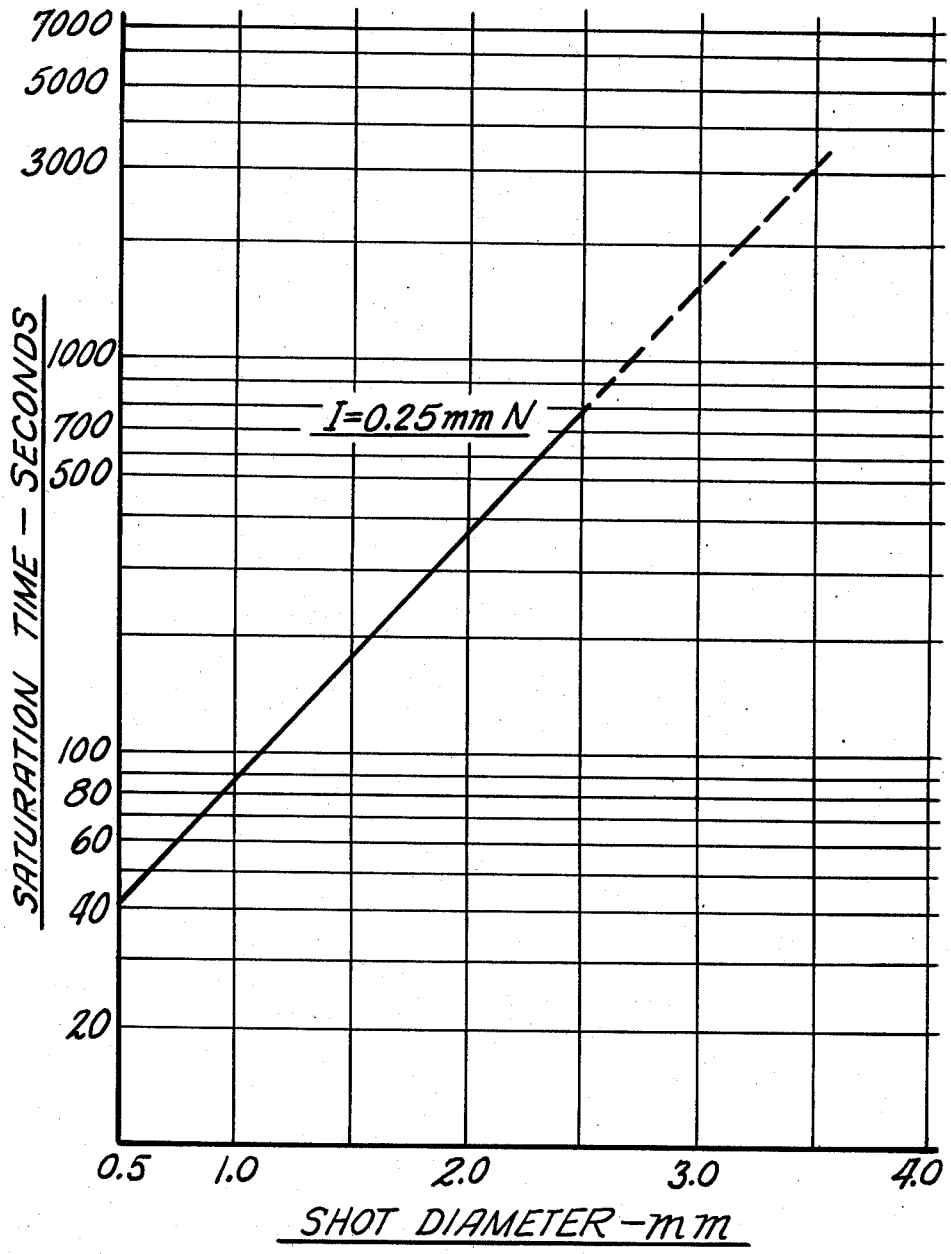
FIG. 1 graphically shows the relationship between saturation time and uniform shot diameter.

The invention herein is described in terms of the finishing of a titanium alloy (Ti-6Al-4V by weight) blade designed for use in the compressor section of a gas turbine engine. The invention is also described in terms of attaining the following objectives: a surface finish of better than 15 AA and a residual compressive stress intensity of 0.25–0.30 N, (in millimeters according to the Almen test). Both parameters are described in more detail below. However, it will be understood that the invention will be useful for finishing other workpieces and metals to other criteria; such as where the surface finish may range up to 40 AA, and the intensity may range between 0.10–1.0 N.

The preferred way of carrying out the invention is to use the apparatus described in our copending application Ser. No. 300,726 "Shot Peening Apparatus" filed on even date herewith, the disclosure of which is hereby incorporated by reference.

In contrast to the shot peening as practiced in the prior art, the present invention employs very uniform sized spherical shot, such as utilized in the construction of ball bearings. The hardness of the shot should be greater than the hardness of the metal being peened, to insure that the shot is not deformed during use. A preferred material for peening Ti-6Al-4V (having a hardness of about Rc 40) is a carbon tool steel, such as AISI C1013, which has been heat treated to a hardness in the range of Rc 60. It is preferred that the shot be of a relatively high density material such as steel. Other materials may be used, but such use will involve tradeoffs of increased cost (for higher density hard materials) and less effectiveness (for lower cost and lower density materials, such as ceramics). The shot material must be infrangible to avoid generation of subsized particles during peening; the importance of this is indicated below.

Most of the shot used in the prior art peening has been selected in accord with specification SAE-J827 for iron or steel, and SAE-J1173 for glass beads and MIL-SPEC-S-13165B. Some representative specification distributions of shot size are shown in Table 1 for the SAE and MIL-SPEC materials. Also shown in the table are three types of shot, NL-10, 18, and 25, (nominally 1.0, 1.8 and 2.5 mm dia.) used in the present invention. Referring now to the table, it will be seen that the prior art shot is characterized by relatively wide distribution. For example, grade S550 contains diameters between 1.18 and 2 mm; glass bead grade GB20 ranges in diameter between 0.125–0.300 mm. In contrast, the shot of the present invention is seen to be uniform within a tolerance of a plus or minus 0.05 mm. In the SAE and MIL-SPEC grades of shot it is expected that there is a normal distribution which includes a certain number of fine shot particles. This is evidenced by the lack of a screen specification for the 99–100% cumulative percentage. In contrast, the grades of shot used in the invention, typified by the NL grades, have 100 percent of the shot entirely within a specified narrow range.

In the practice of the invention, it is important that the shot be spherical. By this is meant any characteristic shot particle should have a radius which does not vary by more than about 2 percent. The sphericity requirements will be understood within the context of the size uniformity requirements, elaborated upon further herein. Irregular shaped shot can provide impacts which are of lower or greater intensity than their spherical equivalent and may not provide the good results of the invention.

TABLE 1

Shot Size Distributions

| | Cumulative Percent of Shot Allowed on A Particular Screen Opening in mm | | | | | |
|---|---|---|---|---|---|---|
| Specification | 0 | 85 | 90 | 95 | 97 | 100 |
| SAE S780 | 2.80 | 2.00 | | | 1.70 | |
| SAE S660 | 2.36 | 1.70 | | | 1.40 | |
| SAE S550 | 2.00 | 1.40 | | | 1.18 | |
| SAE GB20 | .30 | | .180 | .125 | | |
| MIL S280 | 1.19 | | .71 | | | |
| MIL S660 | 2.81 | | 1.67 | | | |
| NL-10 | 1.12 | | | | | 1.02 |
| NL-18 | 1.88 | | | | | 1.78 |
| NL-25 | 2.55 | | | | | 2.45 |

As indicated herein, the invention provides a smooth surface finish on the workpiece being peened, better than 40 AA, and as low as 6 AA. To attain this, it is necessary that the shot particles have at least a commensurate surface finish to that sought. Preferably, the shot should have a finish of 6 AA or better. But, when less fine finish is desired, somewhat poorer shot surface finishes may be usable, up to about 30 AA. Heretofore there has been no particular requirement for shot surface finish in the foregoing range. Somewhat irregular material, characteristic of atomized metal, has been acceptable. The foregoing surface finish requirement in combination with the sphericity requirement, precludes the use of shot containing fragments.

Shot particles must have substantially uniform energy when they impact the workpiece surface. As described in the copending application, the preferred way to achieve this is to discharge the uniform sized shot from a discharge gate (perforated plate) positioned above the workpiece, with a very low uniform velocity. The shot is then allowed to fall by the force of gravity. This will impart to all shot, regardless of size, a uniform acceleration and impact velocity. The velocity at the time of impact will depend on the height of the gate above the workpiece. The energy of a unit shot particle, E, will be determined by the relationship $E=0.5\ mv^2$ where m is the mass and v is the velocity at impact. As is well known the velocity will be determined by the relationship $v^2=2\ gh$, where h is the height, or the distance between the discharge gate and the workpiece and g is the gravitational constant. Thus, the energy of a shot particle at the time it hits the workpiece will be proportionate to h.

When a shot particle having sufficient velocity and mass impacts the workpiece, it will cause plastic deformation and result in a residual compressive stress. The plastic deformation will locally change the contour of the surface of the part. The effects of shot peening insofar as residual compressive stresses are concerned are quantified through intensity, I, measured with an Almen strip (SAE-J442 and AMS 2430). In this method, a strip of SAE 1071 steel, productive of a reading in the Almen "N" range, is subjected to shot peening while clamped in a flat holder. Upon removal fron the holder the residual compressive stresses imparted to the shot peened surface causes the strip to curve. The Almen number is a measure of the height of a curvature of the strip; herein that number is referred to in millimeters.

To set forth the limits of the invention a multiplicity of tests were run using Almen steel and AMS 4928 titanium (Ti-6Al-4V) test strips, and AMS 4928 titanium blades.

The intensity of shot peening, I, was measured using the aforementioned Almen steel strip. The surface finish of the titaniums was measured using a standard surface finish measuring system, such as a Bendix Model QEH Digital Profilometer and Amplimeter Peak Counter (Bendix Automation & Measurement Division, Dayton, Ohio).

Saturation time, T, is a shot peening parameter which is a measure of the time at which peening of the surface is deemed to be complete; it is determined with the use of an Almen strip. Saturation time is defined as that time, which when doubled, causes less than a 10% increase in measured intensity. Low saturation times are desired for economic production.

Numerous experiments were conducted using gravity acceleration and different shot sizes, the results of which are presented hereinafter. It will be seen that the data variously suggest the preferred use of small and large shot sizes. However, when integrated, a relatively narrow range of parameters is found to provide the desired unique combination of surface finish and compressive stress.

FIG. 1 shows the time to saturation at 0.025 N, for various diameter uniform size shot flowing at equal mass rates. It is seen there is a considerable increase in time with increasing shot sizes; e.g., a five-fold increase in diameter from 0.5 mm to a 2.5 mm diameter increases the saturation time by eighteen-fold.

Figure 2:
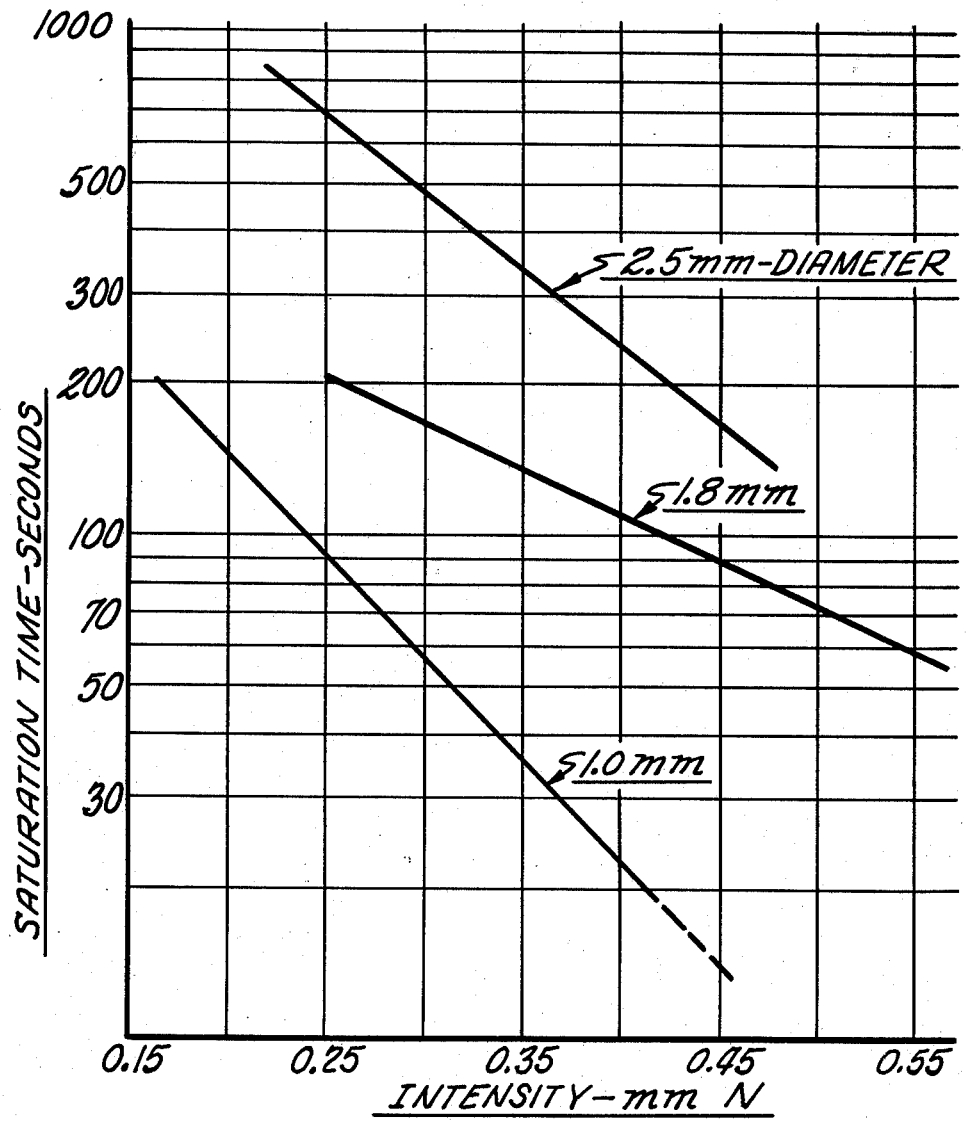
FIG. 2 graphically shows the relationship between peening intensity and saturation time for different shot diameters.

FIG. 2 indicates the trend of saturation time with I, at constant mass flow. At higher I, the time drops considerably. This can be attributed to the greater effectiveness of higher energy or higher velocity shot in transferring energy to the workpiece.

Figure 3:
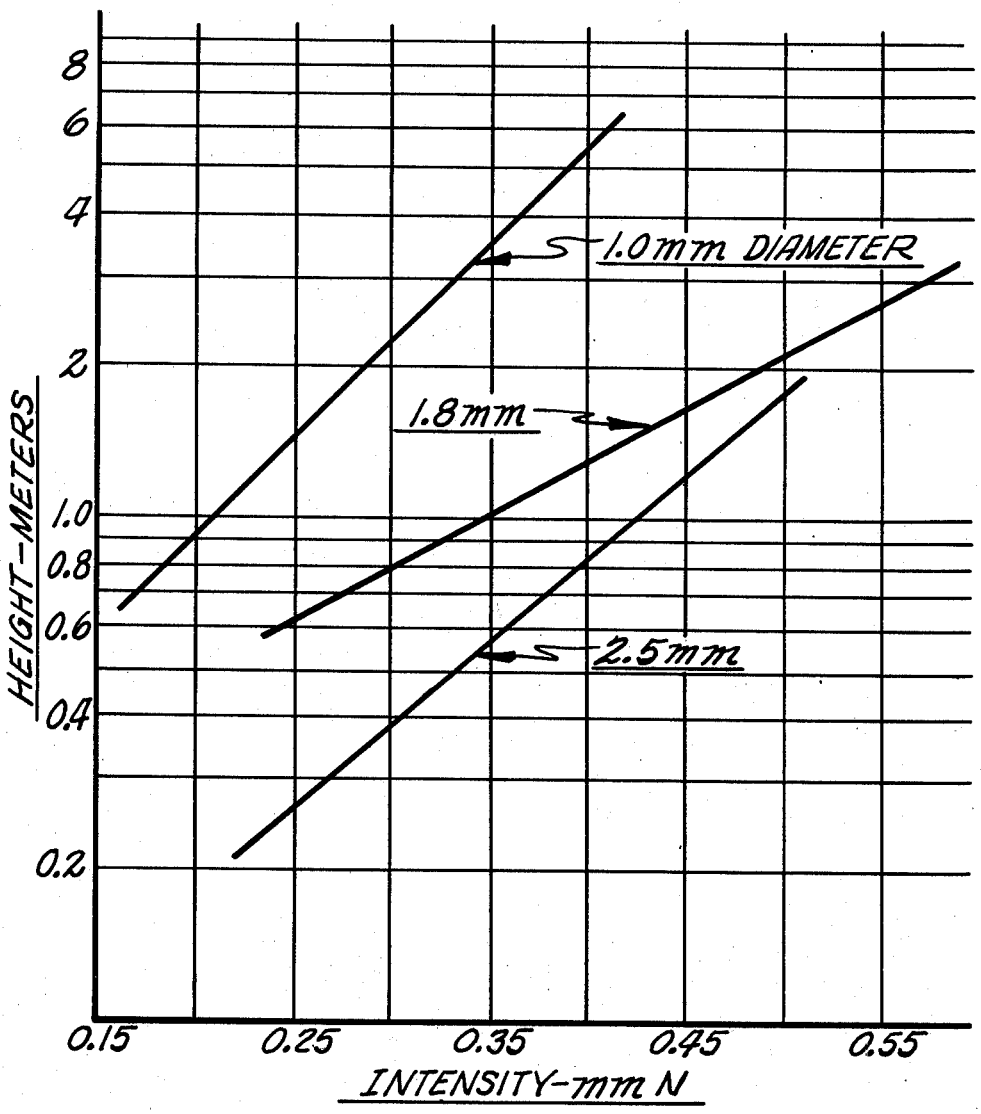
FIG. 3 graphically shows the relationship between the drop height and peening intensity for different shot diameters.

FIG. 3 indicates the relationship between drop height h, and the peening intensity I. It is seen that as desired I increases, the necessary h increases greatly. Because of its greater mass, a larger size shot will be preferred for higher intensity peening. The Figure also indicates that disproportionately large increases in h are needed with increasing I, suggesting a limiting situation insofar as residual stress effects on the metal test strip are concerned.

In FIGS. 2 and 3 there is a lack of consistency in slopes for the three shot sizes. The data for the 2.5 mm shot are limited, but believed valid. It is thought that the changes in slopes reflect energy transfer phenomena and velocity effects which vary in complex fashion as a function of I and shot diameter, and that there is a peaking in the range between 1 and 2.5 mm.

Investigations were carried out on the energy transfer phenomena, and the results illustrate significant differences between the shot sizes. The results will be seen to be supported and correlated with the data in the paper "Residual Plastic Strains Produced by Single and Repeated Spherical Impact", J. A. Pope and A. K. Mohamed, Journal of Iron and Steel Institute, (1955) Vol. 180, pp. 285–297. The new data will be only briefly touched on here.

Table 2 shows various parameters measured for three shot sizes. Among the data are peening intensity, I(N); drop height, h; saturation time, T; total energy, $E_t$ (the product of one-half the total mass flow per unit area, over time T, and the square of the shot impact velocity); the efficiency, Eff, which is the ratio of the impact energy, less the rebound energy, to the impact energy of a shot particle, and it is a measure of the energy transferred to the workpiece by the shot; the energy transferred, $E_{tr}$, which is the product of $E_t$ and $E_{ff}$; and the surface finish, SF.

Figure 4:
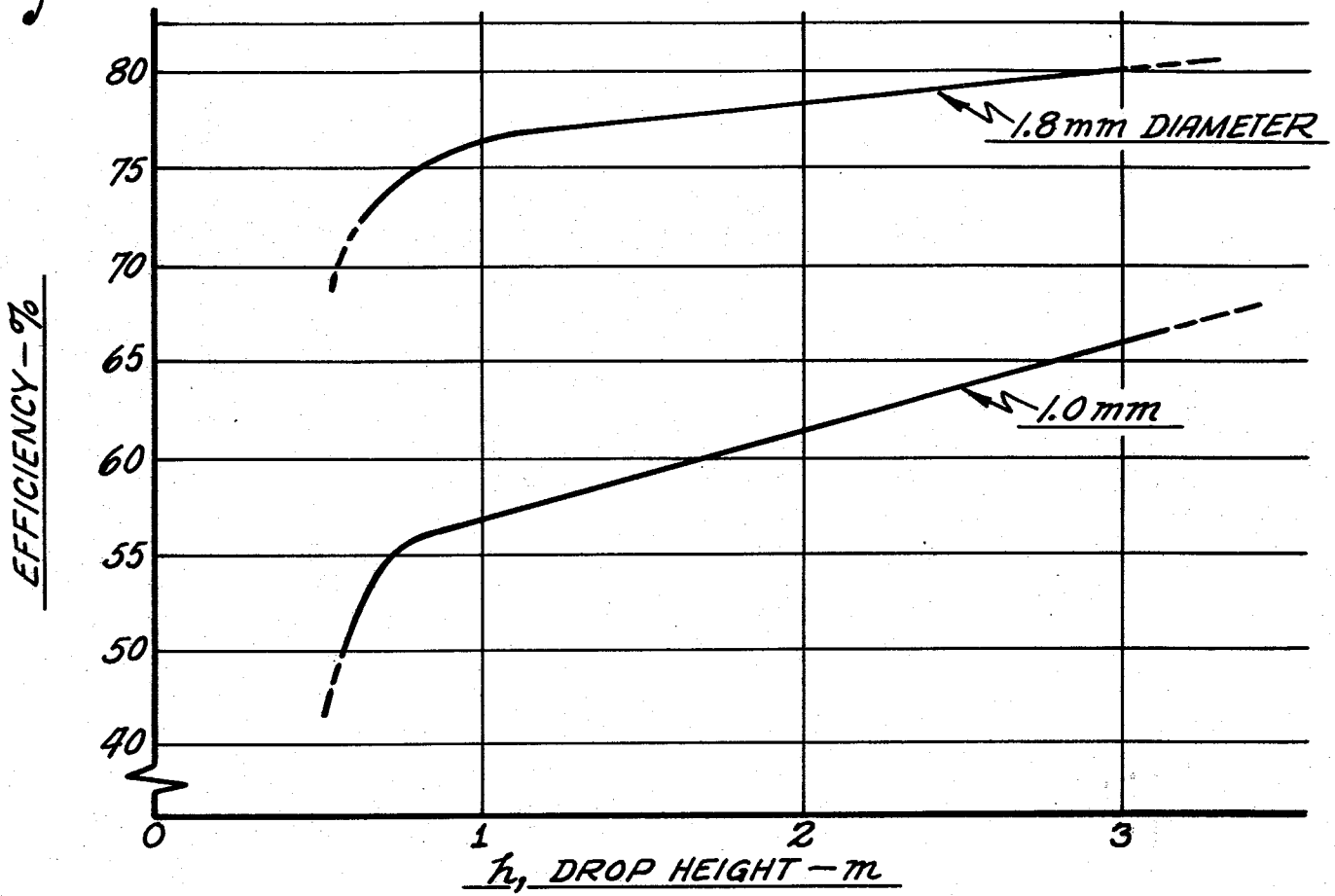
FIG. 4 graphically shows how shot peening energy transfer efficiency varies with drop height and shot size.

FIG. 4 shows the efficiency data from the table, plotted as a function of drop height for different shot diameters.

Referring to the Table and FIG. 4, it is seen that, (a) to achieve a particular I, larger diameter shot requires higher $E_t$; (b) the larger diameter shot is more efficient in imparting its kinetic energy to the workpiece; (c) efficiency falls off sharply when drop height falls below about 0.8 m for the 1–1.8 mm shot; (d) to obtain a certain peening intensity, there is need for more energy to be transferred, $E_{tr}$, when using larger shot.

TABLE 2

| I (N) (mm) | h (m) | Energy Parameters Using Uniform Shot T (sec.) | $E_t$ (J) | Eff. (%) | $E_{tr}$ (J) | SF (AA) |
|---|---|---|---|---|---|---|
| | | | 1 mm shot | | | |
| 0.17 | 0.61 | 180 | 9.7 | 49.2 | 4.25 | 10 |
| 0.24 | 1.22 | 120 | 12.9 | 57.9 | 7.48 | 12 |
| 0.27 | 1.83 | 80 | 12.9 | 59.6 | 7.77 | 12 |
| 0.31 | 2.44 | 55 | 11.8 | 63.6 | 7.55 | 15 |
| 0.32 | 3.05 | 38 | 10.3 | 66.5 | 6.90 | 19 |
| 0.36 | 3.66 | 32 | 10.9 | (68.5) | 7.46 | 19 |
| >0.39 | 4.88 | 24 | 10.4 | (71.0) | 7.38 | 21 |
| 0.41 | 6.10 | 20 | 10.8 | (73.5) | 7.83 | 21 |
| | | | 1.8 mm shot | | | |
| 0.26 | 0.61 | 184 | 12.1 | 72 | 8.71 | 6 |
| 0.30 | 0.74 | 165 | 13.2 | 74 | 9.76 | 9 |
| >0.38 | 1.22 | 113 | 14.9 | 77 | 11.47 | 11 |
| 0.46 | 1.83 | 84 | 16.6 | 78 | 12.95 | 12 |
| 0.53 | 2.44 | 74 | 19.5 | 79 | 15.41 | 19 |
| 0.56 | 3.05 | 55 | 18.2 | 80 | 14.56 | 21 |
| | | | 2.5 mm shot | | | |
| 0.25 | 0.25 | 720 | 32.4 | | | 6 |
| 0.35 | 0.61 | 300 | 33.0 | | | |
| 0.46 | 1.22 | 165 | 36.3 | 90+ | | 12 |

A full discussion of the hypotheses and ramifications relating to the foregoing observations is beyond the present discussion. In summary, it can be concluded that (a) more energy will be consumed when using large shot; and (b) low drop heights not only involve the disadvantages mentioned elsewhere herein, but have associated with them low energy transfer efficiencies. Both the foregoing suggest the desirability of using small shot.

Figure 5:
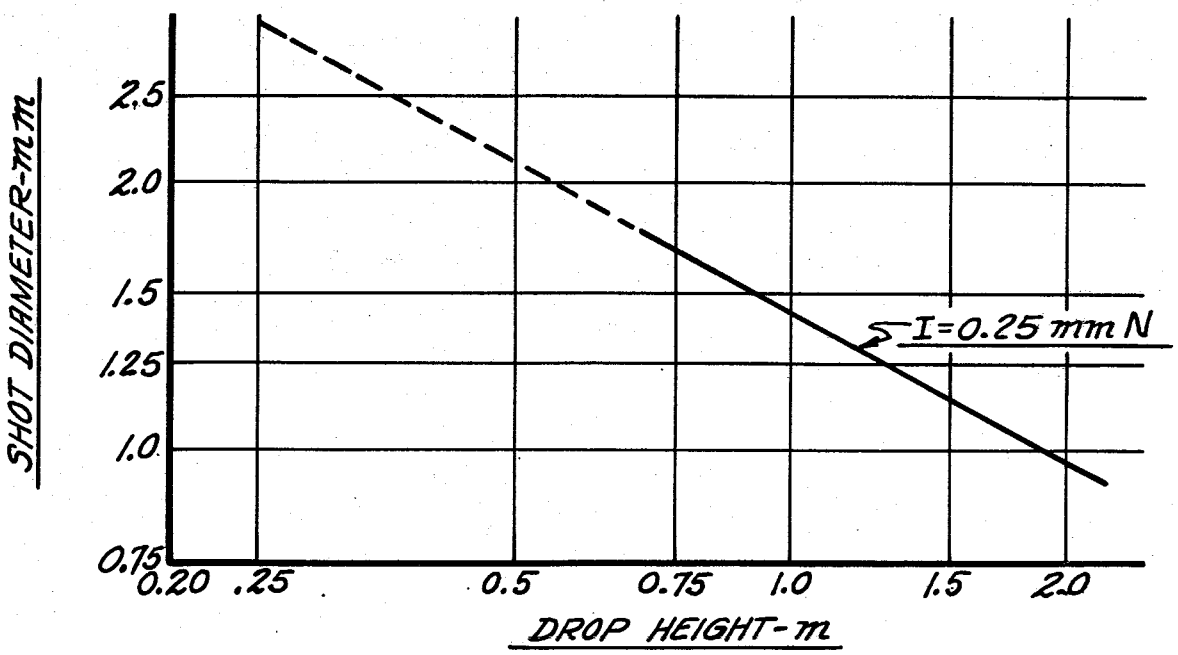
FIG. 5 graphically shows the drop height necessary to obtain a peening intensity of 0.25 mm N, for different shot sizes.

FIG. 5 illustrates the relationship between drop height and the shot size at I of 0.25 N. The drop height decreases geometrically as shot diameter increases. From FIG. 5 it may be seen that when the shot diameter reaches 2.5–3 mm the permissable h becomes small at around 0.25–0.40 m. Such small drop heights are to be avoided, since associated with them are very low impact velocities, less than about 3 m/sec; these make fluctuations in initial velocity more critical. Also, a contoured workpiece such as an airfoil, and particularly one which is rotated or inclined with respect to the shot streamline, may vary in height in space by as much as 50 mm. This will change the effective drop height accordingly and cause unacceptable variations in the impact velocity, with the result that I and finish will vary from point to point on the workpiece. At the other extreme very small shot, such as is common in other shot peening, becomes impractical from the standpoint of requiring infeasible vertical heights (and ultimately encountering aerodynamic drag at high velocities). Substantial drop heights are impractical simply because of the vertical height required in a building, and also because any equipment in which is contemplated the use of different size shot must have the flexibility to provide varying drop heights. When the usable range of drop height must be great, equipment cost increases substantially.

Figure 6:
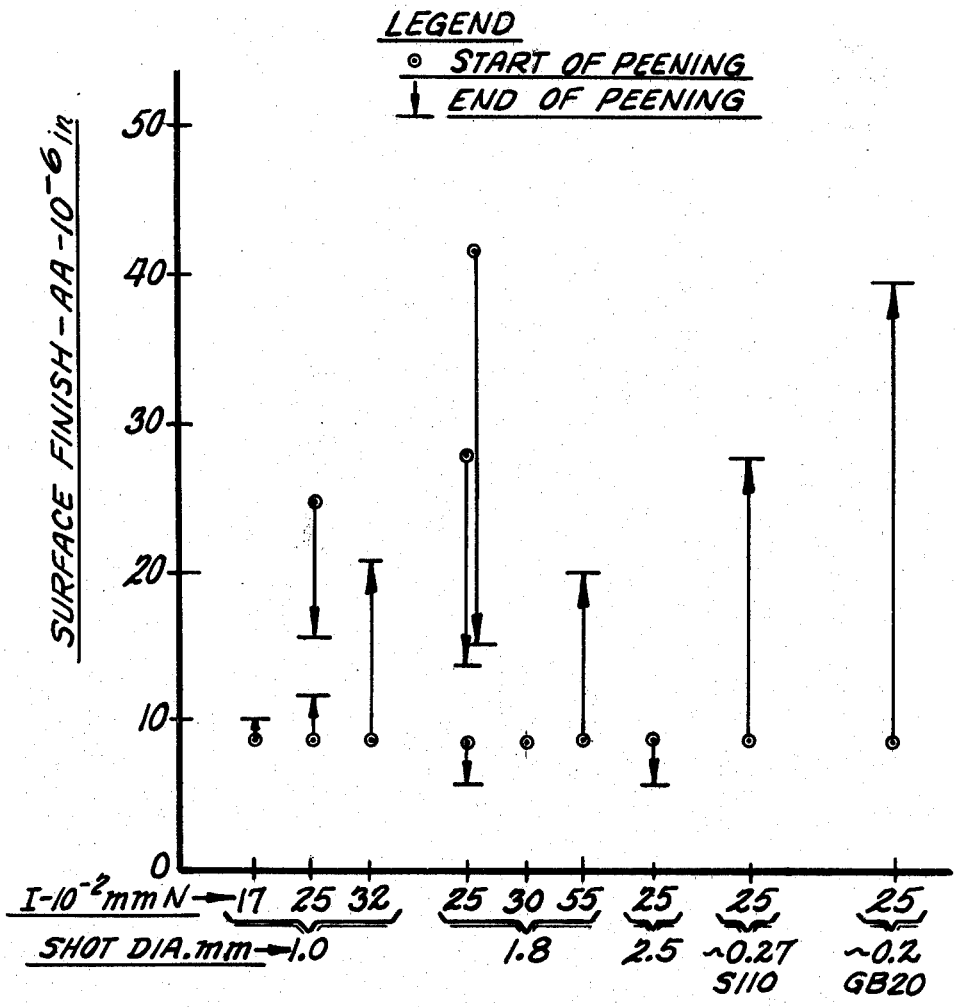
FIG. 6 graphically shows surface finishes which result from the use of different size shot at different peening intensities, according to the starting finish.

FIG. 6 illustrates the surface finish that is obtained at saturation time T, when titanium alloy workpieces are subjected to different peening intensities with different sized shot. For test pieces with initial finishes of 9 AA, it is seen that the larger the diameter shot, the smoother the surface finish produced. For example, at 0.25 N a 1.8 mm shot will produce a surface finish of about 6 AA, whereas a 1 mm diameter shot will produce a surface finish of about 12 AA. It is also seen from the Figure that as the intensity is increased, the resultant roughness of the workpiece increases; that is, there is poorer surface finish. See both the 1 and 1.8 mm data. This is understandable because high intensities have associated with them greater forces and greater degrees of surface deformation of the workpiece. Also shown in the Figure is the finish which is produced by GB20 glass beads. At around 40 AA, it is considerably inferior to the finish which can be obtained in the practice of the present invention. FIG. 6 also shows how 1 and 1.8 mm shot are effective in reducing the surface finish of a previously rough surface. For example, a GB20 finished panel at 42 AA is provided with a surface of about 15 AA using 1.8 mm shot at 0.25 N.

Figure 7:
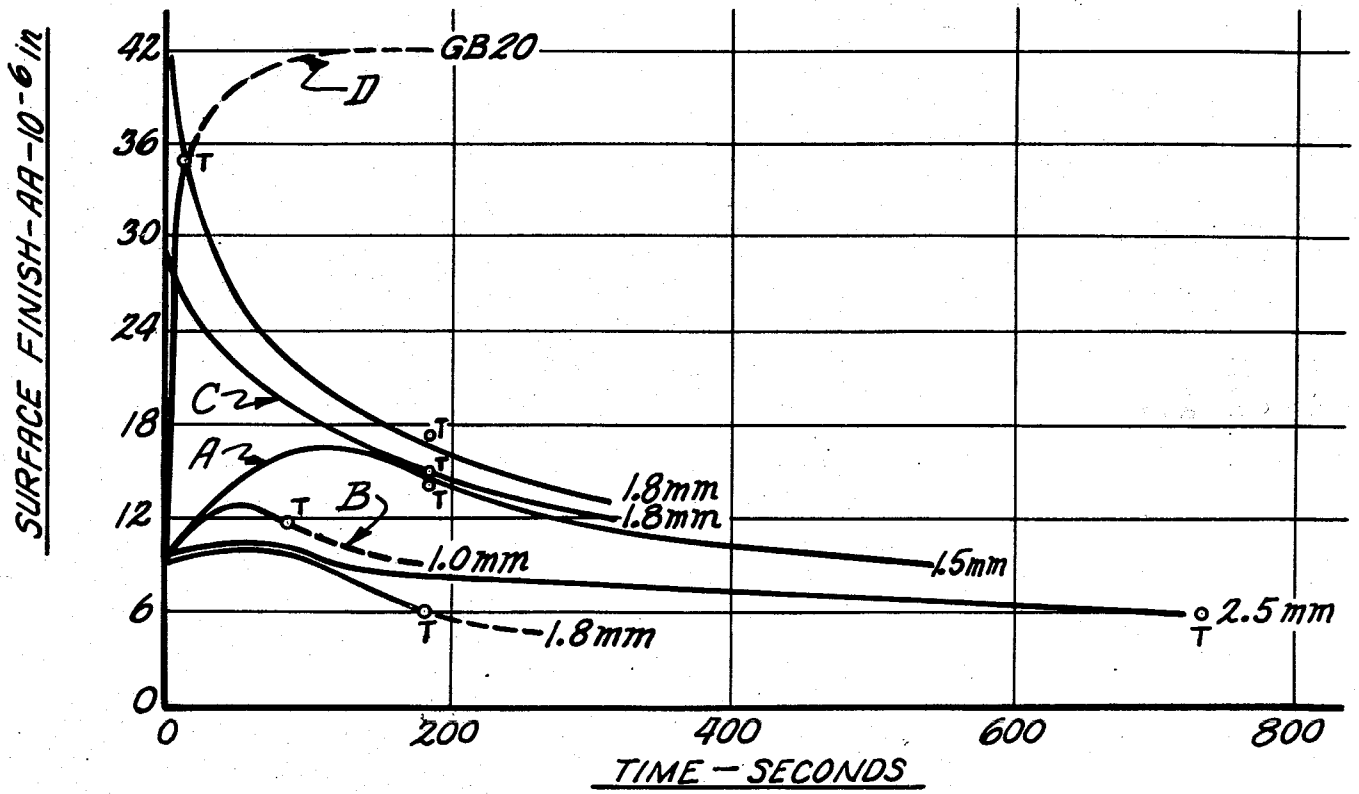
FIG. 7 graphically illustrates how surface finish varies with peening time for different shot sizes.

FIG. 7 further illustrates the smoothing effect. Referring to curves A and B, there is initially a roughening of initially smooth specimens, followed by smoothing at T, and still further smoothing if peening is continued. For initially rough panels, there is a progressive smoothing; at T, the preponderence of the smoothing which is possible has been obtained, as curve C illustrates. Curve D illustrates the roughening which the prior art glass bead peening provides, when saturation time is reached. Curve D portrays the behavior of regular GB20 glass beads. Since within the typical GB20 mass is a certain quantity of broken beads, continued peening time will produce no change in finish. However, if specially selected (virgin, unused) glass beads are used, there can be an improvement.of surface finish to the range of 30 AA, if peening is continued beyond saturation time.

While it is possible to improve the finish of parts, the final finish obtained will be dependent on the initial workpiece finish. To obtain finishes of 15 AA or better, with 1–2.5 mm dia shot, it is necessary for the initial workpiece finish to be less than about 40 AA. In some workpieces there are considerable heavy machining marks, waviness, and other gross effects which normally influence surface finish measurements. Peening will not affect such gross defects. Therefore our surface finish statements herein refer to surface roughness on a smaller scale, when the influences of the gross defects have been subtracted out.

From the foregoing, it is indicated that peening with large size shot will only result in smoothing to the desired degree if the peening is carried out for at least the saturation time, T. Of course, there is an economic incentive to choose a shot which gives the desired finish and I in the minimum time and the invention herein involves the discovery of the critical parameters which provide these optimum parameters.

Figure 8:
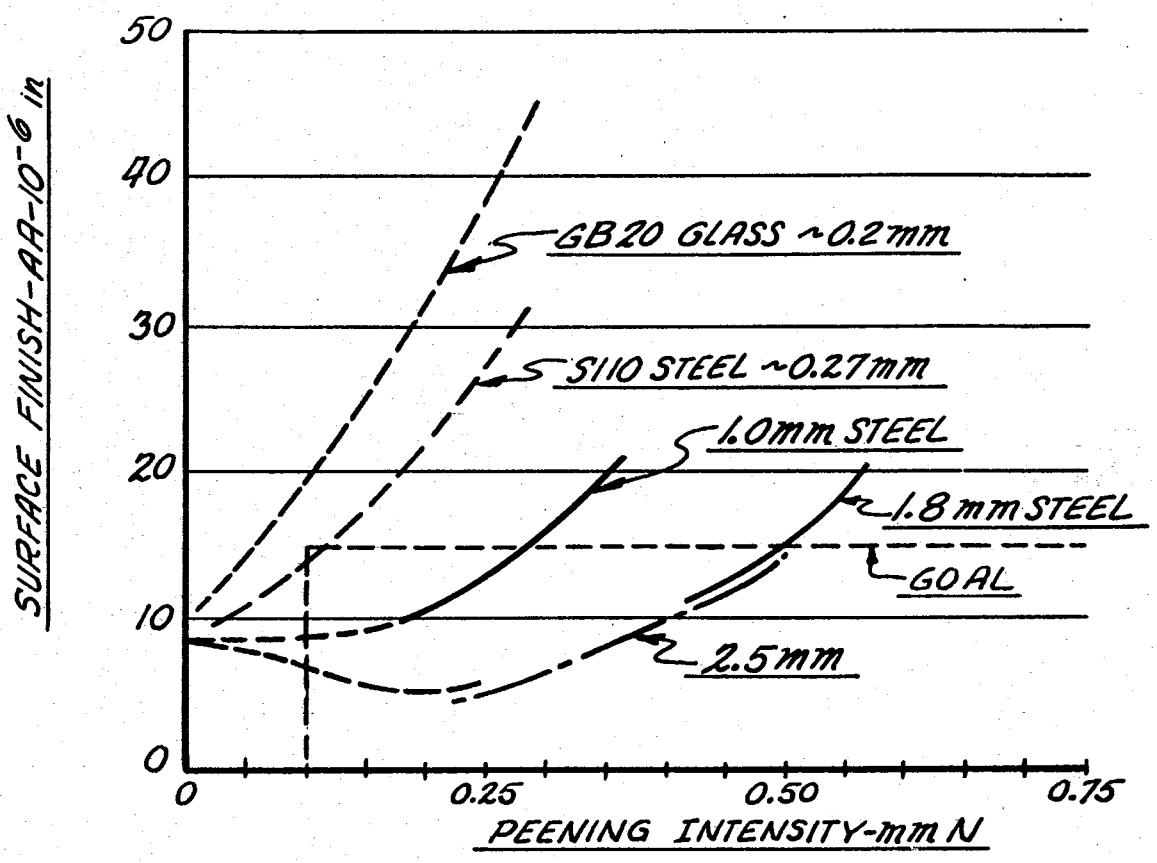
FIG. 8 graphically illustrates the interdependency of surface finish and peening intensity for different sizes of shot.

FIG. 8 correlates the foregoing data, showing the important relation of finish with peening intensity. It is seen that as I decreases, the surface finish improves. It is seen that the S110 steel shot and the GB20 glass will not provide the desired results. Only larger shot will produce a very smooth finish while simultaneously providing significant I. The dashed box line on the Figure indicates the desired finish and peening intensities for titanium airfoils. Shot in the range 1–2.5 mm dia. is usable. But, it is seen that for a finish less than 15 AA, the 1 mm shot can only be used up to an I of about 0.30 N. Although data was not obtained it appears evident that shot substantially less than 1 mm, below 0.8 mm, will not be useful.

Figure 9:
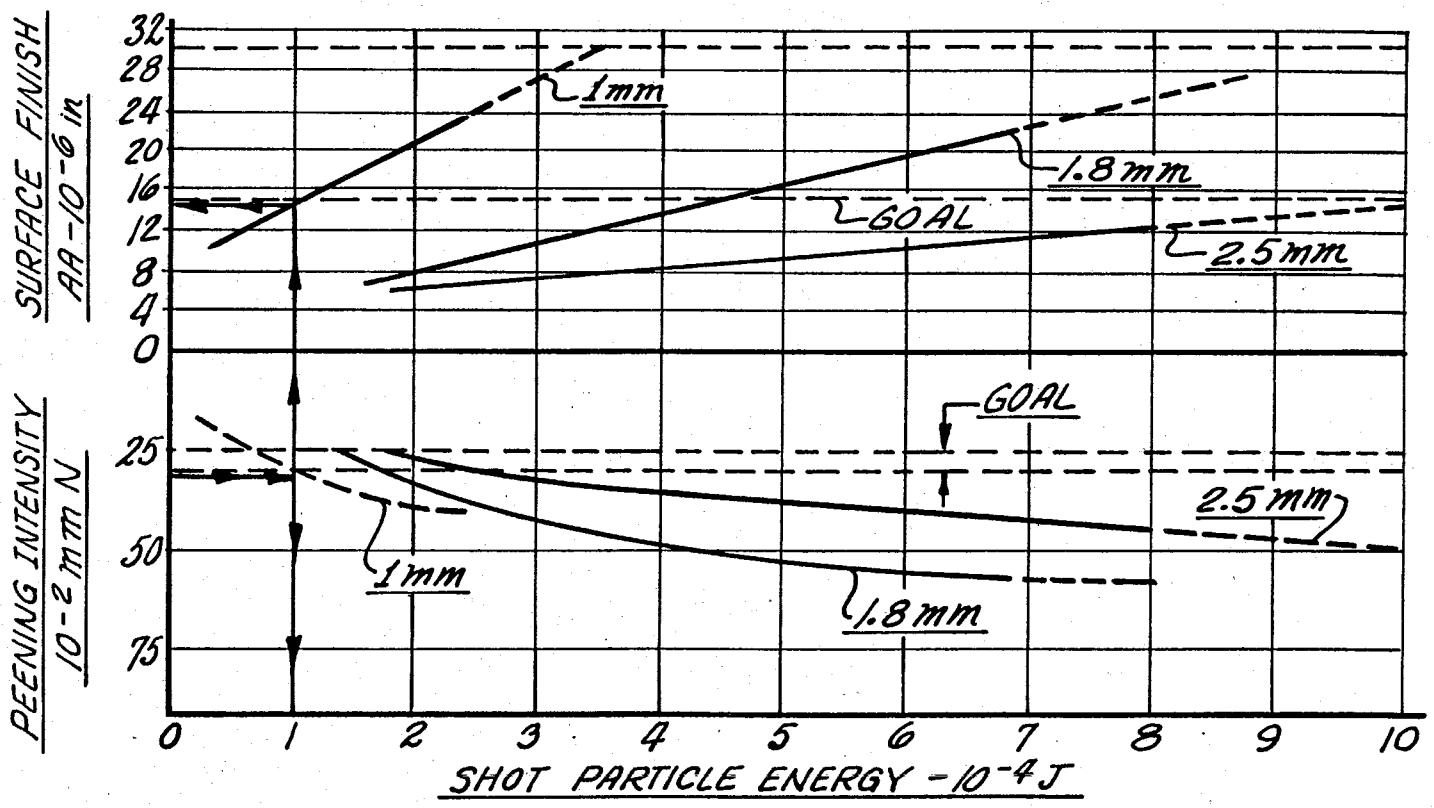
FIG. 9 graphically interrelates peening intensity, surface finish, and kinetic energy of the shot, for different sizes of shot.

FIG. 9 correlates the foregoing data with the input energy, E, which as pointed out was proportionate to drop height, h. Using as an example goals of 0.30 N and less than 15 AA, the FIG. 9 curve is used by first entering at the desired intensity, 0.30 N. Moving to the right, the 1 mm curve is first intersected. Traveling from the intersection vertically downward, the energy per unit shot particle needed to obtain the desired I is indicated as $10^{-4}$ J. (From this the height can be easily calculated). Traveling vertically upward, another curve form 1 mm shot is intersected, and an ordinate location associated therewith indicates a surface finish of about 15 AA will result from the E and shot diameter. Treating the graph similarly for the same 0.30 N, but with 1. 8 mm shot diameter shows that higher unit shot energy level of $1.8\times10^{-4}$J is required but that a better surface finish of 8 AA will be obtained.

Figure 10:
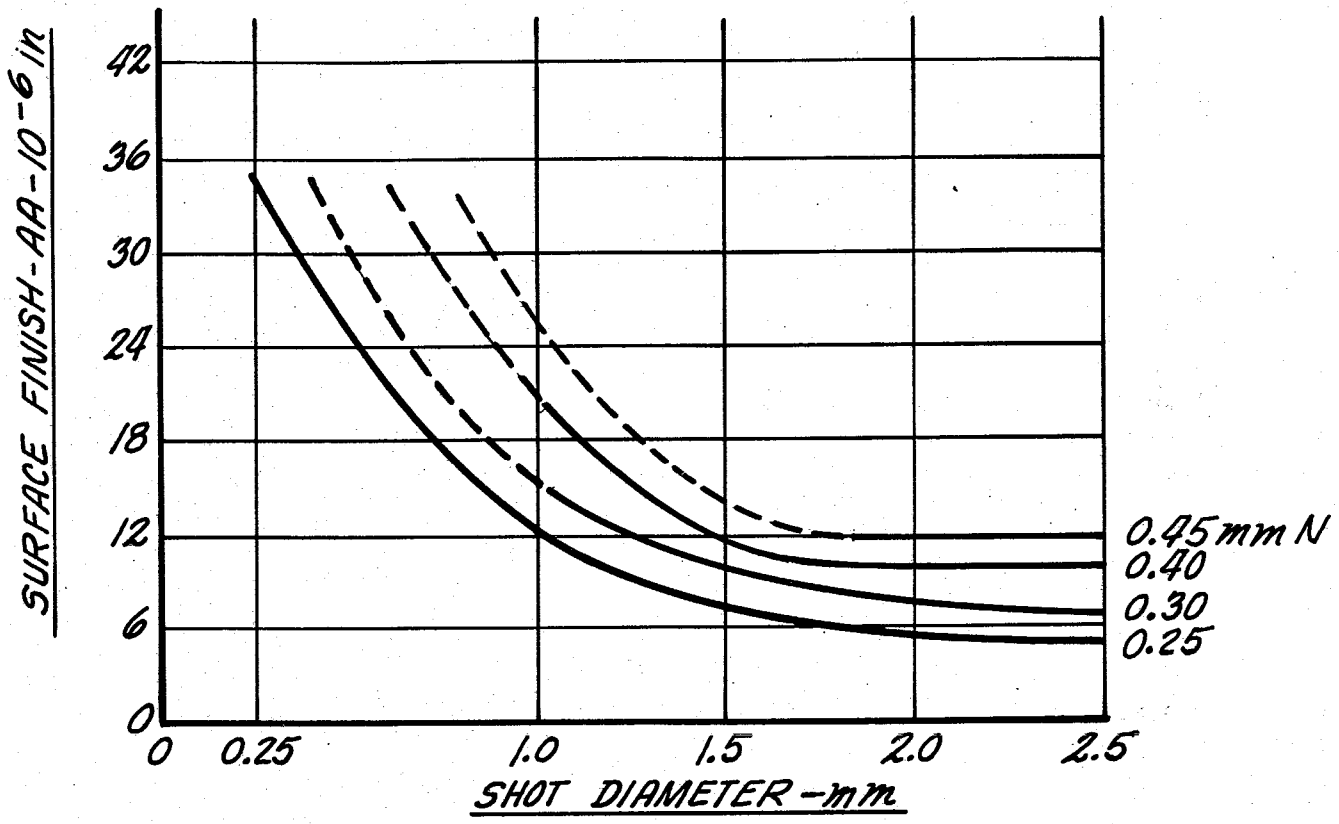
FIG. 10 graphically shows the dependency of finish on shot size.

FIG. 10 shows the relationship between shot size and surface finish, utilizing the same data as in FIGS. 8 and 9. It is seen that when a shot size of greater than about 2 mm is reached there is unexpectedly not a significant further increase in surface finish.

Figure 11:
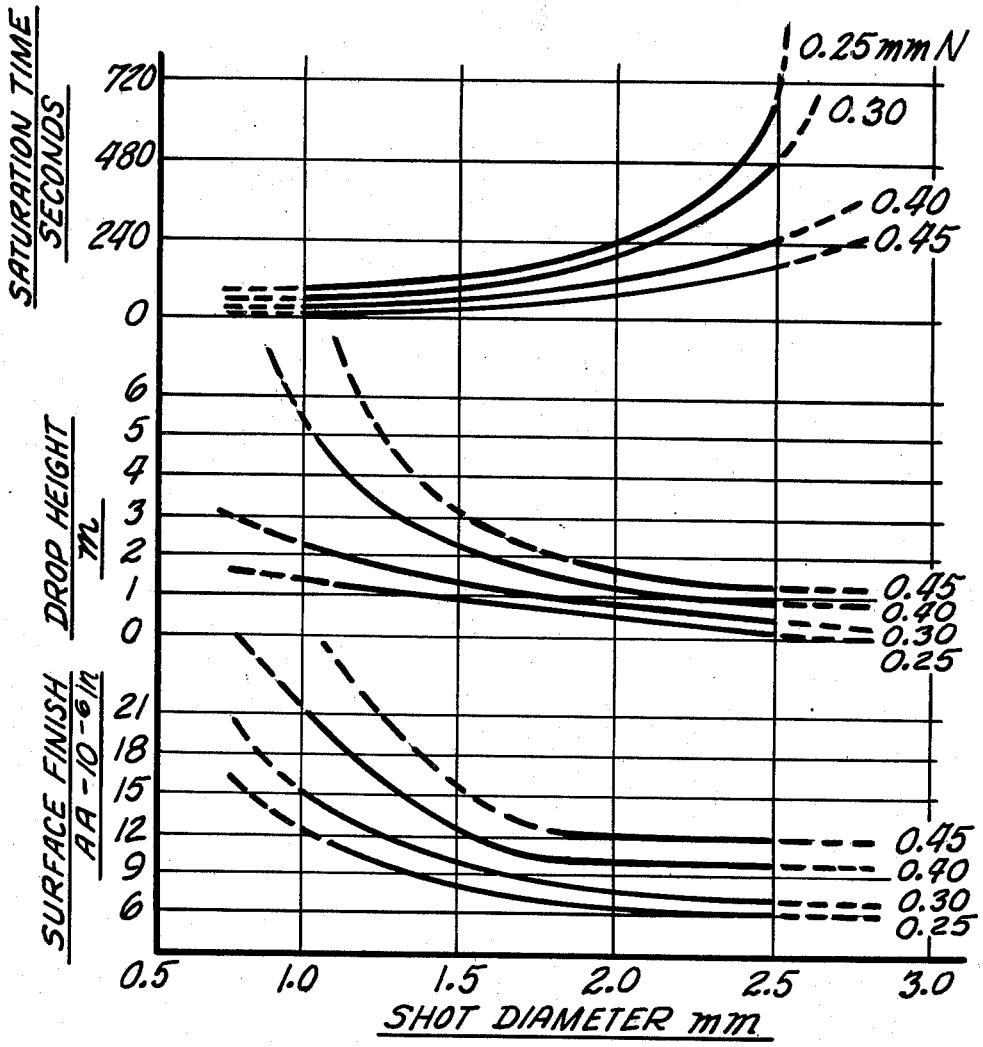
FIG. 11 graphically shows the changing interrelationship between saturation time, drop height, and surface finish, as a function of shot size.

FIG. 11 is a summary of the prior data and graphically indicates the preferred shot size. It is seen that between 2–2.5 mm diameter, surface finish does not improve, while saturation time goes up substantially. The time disadvantage is more pronounced for the lower I values and has associated with it low drop height. Thus, for I less than 0.40 N, size should be less than 2 mm; for I above 0.40 N, shot size up to 2.5 mm may be used.

Small shot sizes, less than 1 mm, have associated with them, poor workpiece finishes and in the case of high I, excessive drop heights. Thus, the shot size should be no less than 1 mm, and preferably greater than 1.5 mm.

In summary it is seen that there is a range of shot size, of about 1.5–2 mm where optimum results are obtained, and a range 1–2.5 mm which produces a superior coxbination of surface finish and compressive stress, for particular intensities, compared to the prior art.

Most of our concern herein has beenwith peening intensities of greater than 0.25 N, however lesser intensities will be on occasion found useful, down to about 0.10 N. They may be provided in the practice of the invention as reference to the figures and limited extrapolation will show. To achieve low intensities, shot diameters from the smaller end of the range will be selected, since required velocities and drop heights become undesirably small for shot in the larger diameter end of the range.

The 1–2.5 mm steel shot particles used in our experiments had a diameter tolerance of ±0.05 mm and a specific gravity of about 7.8. Thus, the diameter was uniform within ±2.5% for the 2.5 mm shot and ±5% for the 1 mm shot. The nominal particle mass ranged between $4\text{–}64\times10^{-3}$ gm; and the mass at a given diameter varied between ±6–15%, the smaller percentage being associated with the larger shot size.

The range of velocity which is usable in the invention is dependent both on the size of the shot (necessary to achieve the energy which produces the desired peening intensity) and practical limits relating to how the shot is accelerated. While we conceive of other means of accelerating shot, only gravity acceleration appears presently to have both simplicity and consistency in providing uniform velocity. Therefore our practical limits are related to the drop heights which are feasible. The drop height should be more than 0.1 m, very preferably greater than 0.3 m, and most preferably in the range 0.6–3 m. When the drop height becomes too low, variations in the placement or controlled movement of the airfoil may significantly affect impact velocity, and thereby the precision of peening required to achieve the objects of the invention. Heights beyond 6 m are considered by us to be excessive and impractical, although they are feasible. For the 0.1–6 m drop heights, impact velocity will range over 1.4–12 m/sec; for 0.3–3 m drop; velocity will be 2.5–7.8 m/sec in gravity acceleration using the apparatus described in the referenced applications, impact velocities were uniform within ±4%.

When obtaining 0.1–0.6 N intensity, and smoother than 30 AA finish, and using 1–2.5 mm shot, FIG. 9 shows the unit shot energy will range from approximately $0.2\times10^{-4}$J to $12\times10^{-4}$J. For the use of the method in peening titanium airfoils to 0.25–0.30 N and less than 15 AA finish, the unit energy range will be about $0.6\times10^{-4}$ to $3\times10^{-4}$J.

We have indicated the criticality of the peening parameters on the results obtained. The mass and velocity, must be substantially uniform, within the context of the foregoing tolerances. The mass and velocity tolerances are cumulative in their effect on energy and peening intensity. The permissible tolerance for the energy level within a shot stream depends on the relationship between the desired intensity and finish which has been presented herein, and the requirements of the particular application. Generally, in most applications it is preferred that the energy level be held within about 15 percent for best results and dependable saturation times; with the above presented mass tolerances of ±6–15% and velocity tolerances of ±4% (meaning $v^2$ is ±16%), a statistical summation indicates energy tolerance is about ±25%, and this has provided good results.

The foregoing tolerances should not be taken as absolute since they are approximations based on the extensive but not entirely complete work which has been done. Obviously, a closer tolerance in one parameter enables a lower tolerance in a related parameter. Within the context of the prior art, the foregoing peening parameters tolerances given may justly be characterized as substantially uniform. Reference to the specifications for shot used in the prior art will show that the shot particle masses vary much more than a hundred percent and with the mechanical and fluid acceleration, there are great variations in velocity as well. Almost needless to say, the resultant energy varies even more.

The practice of our invention calls for substantially uniform shot velocities. The copending application Ser. No. 300,726 "Shot Peening Apparatus" indicates how uniform velocities may be attained using gravity acceleration. However, any mode of propelling the shot may be used, so long as the criteria of the invention are met. Also, the best mode involves peening in dry air. In special circumstances, the invention may be carried out as well in other environments, such as in liquids or vapors.

Since the invention provides for the use of substantially uniform size shot, it would at first appear that the use of two or more different sizes of shot would not conform with the invention. It is true that the preponderance of the shot must be substantially uniform at the selected size to effectively practice the invention. And inclusion of any significant quantity of shot which is substantially larger than—outside the tolerance of—the selected size will not be in accord. However, the presence of some smaller shot is contemplated as lying within the scope of the invention when such inclusion may be desirable for secondary purposes or is without specific purpose. The reasoning behind this is as follows.

The time to saturation is the measure of time upon which the desired residual stress accumulates. This in turn is a direct function of the number of impacts and energy of each impact which the surface receives. Therefore, decreasing the mass flow rate will increase the saturation time in inverse proportion to the change. From the data presented, it will be understood that using gravity accelerated shot, all the shot in a mixed size mass will have the same velocity. The energy will be less for the smaller shot particles and the intensity produced therefrom will be less. Accordingly, it can be seen that if the shot size was mixed, for example if 1.8 and 1 mm shot were mixed together, the time to saturation will be longer than the time for either of the independent shot sizes. Saturation time and intensity will be controlled only by the larger shot size, the mass flow of which would be effectively reduced.

Thus, the presence of smaller shot will merely serve to extend the saturation time. Where the small shot hits, the I will be lower than that desired, which will be that provided by the larger size shot. In a mixed size shot mass, at best the presence of small shot will be benign. At worst, it will be impelled with unwanted excess energy, as when a largeshot drives a small shot against the workpiece, and locally causes a poor surface finish and excess intensity.

Other shot material than the steel of our best embodiment may be used. The shot must be of a material harder than the workpiece, and elastic in its impacts with the workpiece and apparatus. It must be substantially infrangible, that is, significant amounts cannot fragment during impact with the workpiece or pieces of the apparatus. The good results we obtained are based on the relationships between energy and diameter. Thus it would appear that, for example, a low density material impelled at a given velocity may produce the same results as a higher density material with the same energy and a lower velocity. While this is true qualitatively, there is probably a velocity effect which we cannot presently fully delineate, and low and high density particles of equal energy may not produce comparable results. Evidently, absolute velocity level is influential. This is suggested by the data in Table 2, when comparing 1 and 1.8 mm shot. When both sizes are dropped from 1.22 m height, they yield essentially the same surface finish of about 11–12 AA. Compare the data for 1 mm at 0.24 N and 1.8 mm at 6.38 N in Table 2. When the 1 mm shot is dropped from 4.88 m, it produces about the same intensity as 1.8 mm shot for 1.22 mm. See FIG. 3 and Table 2. However, the 1 mm shot under such conditions produces a surface finish of 21 AA. Since lower density media by its nature would have to be used at higher velocities, this data suggests that it may have limited utility, and heavier materials with equal or greater density to steel are preferred.

As indicated the bulk of our work was done with steel test specimens, and Ti-6Al-4V titanium alloy workpieces and test specimens. The results herein reflect the materials used, but we believe that analogous results will be obtained on other materials having like properties. In this we include generally titanium alloys and ferrous alloys, as well as nickel alloys, and other materials which have been peening by prior art processes.

Other inventions have relation to the present invention. Ser. No. 300,727 "Peened Overlay Coatings" describes dense and smooth coatings which are produced in a specialized use of the present invention. Ser. No. 300,723 "Duplex Peening and Smoothing Process" describes a two step process, including use of the present invention, to finish workpieces with small inside radius surface contours, such as where an airfoil joins the platform of a blade. Ser. No. 300,718 "Method of Peening Airfoils and Thin Edged Workpieces" describes how thin edged workpieces are manipulated to obtain good results with the present invention, without damaging the edges by direct impact of large shot.

Although this invention has been shown and described with respect to a preferred embodiment, it will be understood by those skilled in the art that various changes in form and detail may be made without departing from the spirit and scope of the claimed invention.

We claim:

1. The method of surface treating a workpiece, to provide residual compressive stresses corresponding to a peening intensity of at least 0.1 mm N and a surface finish smoother than 40 microinch AA, characterized by impacting the workpiece surface with spherical shot particles, the shot particles being infrangible, having a hardness greater than the workpiece, a surface finish better than 30 microinch AA, and diameters lying in the range 1–2.5 mm which are substantially uniform to within at least ±5%.

2. The method of claim 1 wherein the shot particle masses are uniform within ±16%.

3. The method of claim 1 wherein the shot particles have a velocity in the range 1.4–12 meters per second, uniform within ±4%.

4. The method of claim 3 wherein the velocity is in the range 2.5–7.8 m/sec.

5. The method of claim 1 wherein the shot particle diameters are in the range 1.5–2 mm.

6. The method of claims 1, 2, 3, 4 or 5 wherein the peening intensity is in the range of 0.1–1.0 mm N as measured by the Almen method.

7. The method of claim 6 wherein the shot particles have unit energies in the range $0.2\times10^{-4}$ to $12\times10^{-4}$J.

8. The methods of claim 6 wherein the shot particles are accelerated by gravity over a ,distance 0.3–6 m.

9. The method of claim 5 further characterized by the shot mass and velocity being selected to provide a peening intensity in the range 0.20–0.50 mm N and a surface finish of at least 15 microinch AA in a titanium alloy workpiece, the mean shot unit energy lying in the range $0.6\times10^{-4}$ to $3\times10^{-4}$J.

10. The method of claim 9 further characterized by the shot being hardened steel.

11. The method of claim 1 further characterized by finishing the workpiece to a surface finish of less than 40 microinch AA prior to peening, to provide a surface finish of at least about 15 microinch AA after peening.

* * * * *